US006454115B1

(12) United States Patent
Allasia

(10) Patent No.: US 6,454,115 B1
(45) Date of Patent: Sep. 24, 2002

(54) CONTAINER CONSTRUCTION

(75) Inventor: Alberto S. Allasia, New York, NY (US)

(73) Assignee: Cindy Chwang Allasia, New York, NY (US)

( * ) Notice: Subject to any disclaimer, the term of this patent is extended or adjusted under 35 U.S.C. 154(b) by 0 days.

(21) Appl. No.: 09/694,526

(22) Filed: Oct. 23, 2000

(51) Int. Cl.[7] ..... B65D 43/16; B65D 47/08

(52) U.S. Cl. ..... 220/4.23; 220/832; 220/839; 220/835; 206/540; 206/762; 206/751; 53/467; 53/473

(58) Field of Search ..... 220/4.21–4.24, 220/831, 832, 833, 835, 837–839, 847; 206/540, 762, 751; 53/467, 473

(56) References Cited

U.S. PATENT DOCUMENTS

| | | | | | |
|---|---|---|---|---|---|
| 993,469 | A | * | 5/1911 | Stocker | 312/266 |
| 1,842,603 | A | * | 1/1932 | Gray | 220/831 |
| 2,544,975 | A | * | 3/1951 | Berger | 220/831 |
| 2,765,949 | A | * | 10/1956 | Hillman | 220/835 |
| 2,850,200 | A | * | 9/1958 | Hofmann | 220/832 |
| 3,186,574 | A | * | 6/1965 | Davidson | 220/835 |
| 3,221,919 | A | * | 12/1965 | Gessner | 220/832 |
| 3,985,409 | A | * | 10/1976 | Kneier | 312/266 |
| 4,449,628 | A | * | 5/1984 | Egly et al. | 220/832 |
| 4,986,415 | A | * | 1/1991 | Posso | 206/308.3 |
| 6,269,969 | B1 | * | 8/2001 | Huang et al. | 220/835 |

FOREIGN PATENT DOCUMENTS

| | | |
|---|---|---|
| FR | 1426373 | * 12/1965 |

* cited by examiner

*Primary Examiner*—Nathan J. Newhouse
(74) *Attorney, Agent, or Firm*—Schweitzer Cornman Gross Bondell LLP

(57) ABSTRACT

A container particularly adapted for small confectionery items and the like has a bottom with a floor and surrounding walls. The rear wall is of reduced height in comparison to the other walls. A cover having a rear wall pivotally affixed to a top edge of the bottom rear wall. When the cover is in a vertical position the cover's rear wall extends horizontally rearwardly from the bottom rear wall, forming a balcony-like extension to the floor, allowing product to be loaded into the container to be supported thereon during a filling process. When the cover is closed the product on the balcony is directed into the main container volume, allowing a more dense packing of the product to be achieved.

9 Claims, 3 Drawing Sheets

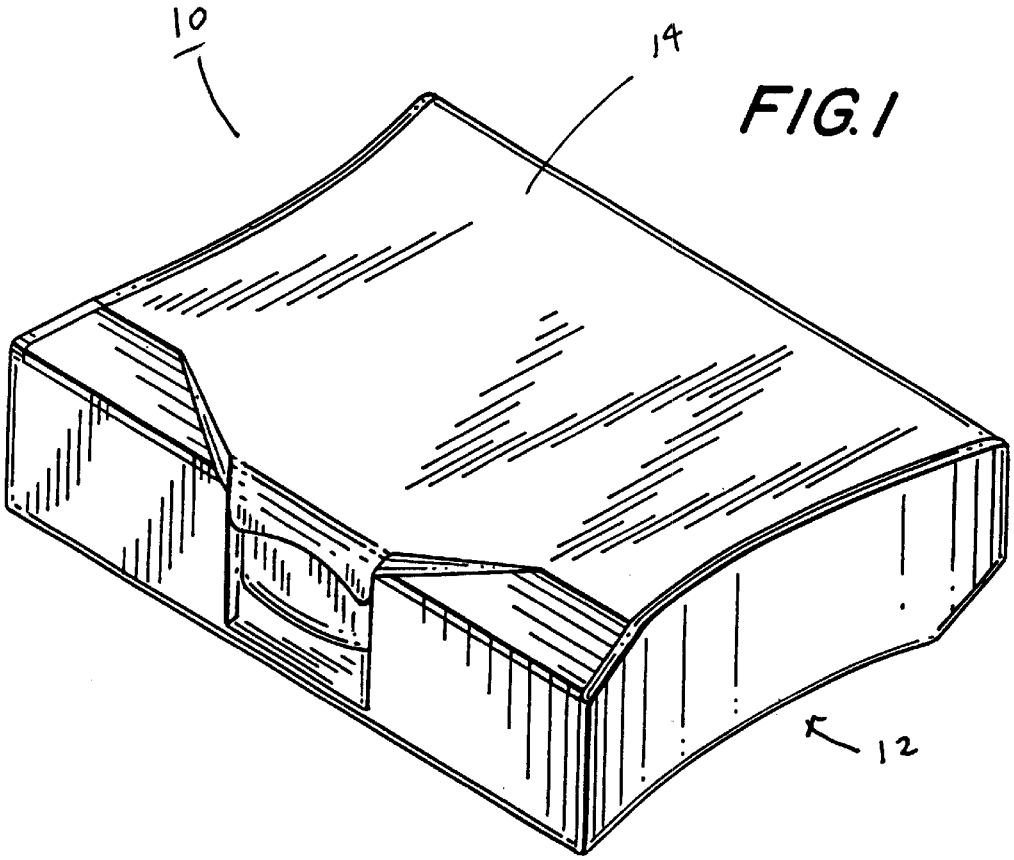
FIG. 1
FIG. 2
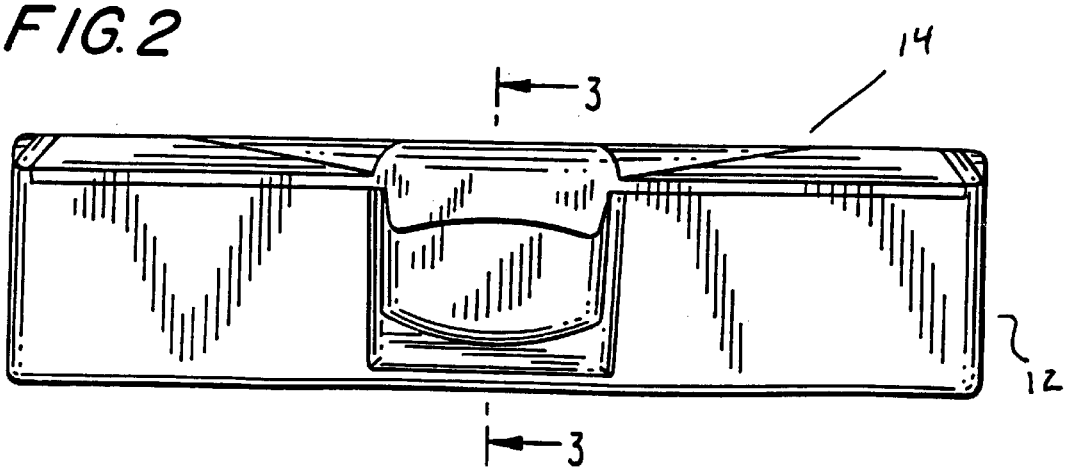

CONTAINER CONSTRUCTION

The present invention relates to a new and improved container construction, and particularly such a container construction which may be used for the packaging of candies, mints, and the like.

BACKGROUND OF THE INVENTION

Through the late 1970's, the packaging for breath mints, small confectionery and similar items, such as candies, was exemplified by a cylindrical stack of individually unwrapped items within an outer wrapping. Product consumption was accomplished by the unwrapping of the package to the extent necessary to expose an individual unit for extraction. The packaging was then rewrapped about the remaining stacked items. The wrapping often tore, limiting the ability for rewrapping. In addition, the wrapping could become unintentionally unwrapped, thus allowing the items to fall out or become soiled.

In the late 1970's such products, as exemplified by mints, began to be packaged unwrapped in hard plastic sealed containers with a small opening with a pivotable cover through which the items could be extracted. Often, however, multiple units would be removed from the container when a single item was desired. Other types of packaging provide unwrapped items in a lipped container, which is simply opened and the desired item or items extracted by hand.

The forgoing containers are to be carried on or with a person and are often displayed on a desk or table and the like. Such containers must store the products in a sanitary manner, and allow the contents to be easily withdrawn for dispensation. Because the containers are both displayed in a store environment for purchase by the consumer and are in public view by the consumer when a candy or mint is dispensed therefrom, the physical appearance of the container can enhance the marketability of the products contained therein.

While an aesthetically attractive container is of commercial benefit, it is as advantageous for the container to be of a construction which allows the container to be easily and properly filled with the product. It has heretofore been difficult to provide a product package which successfully meets the aforementioned criteria, and which can be manufactured economically, particularly when wrapped items are loaded. The wrap for the products increases the volume for each individual item, thus causing underfilling of conventional containers when a fill is determined by contents level. In addition, even when a weight determination is used, the increased size of the individual items can prevent the proper quantity of items to be inserted into the available container volume.

It is accordingly a purpose of the present invention to provide a new and improved rigid container construction of a type especially effective for the packaging of candies, mints and other small objects.

It is further a purpose of the present invention to provide such a container which may be manufactured in an economical and effective manner from known plastic compositions.

It is a still further purpose of the present invention to provide such a container which can be constructed in a molding process in the form of a unitary construction and which, during the manufacturing process, can be efficiently filled with contents.

Yet another purpose of the present invention is to provide a container which allows complete filling with the desired contents, and particularly with wrapped items.

BRIEF DESCRIPTION OF THE INVENTION

In accordance with the foregoing and other objects and purposes, a container construction of the present invention is in the form of a shallow box having a hinged top or cover joined to the main portion of the container and which may be opened for access to the container interior. The rear wall of the container bottom is of lesser height than the other walls, while the cover has a depending rear wall dimensioned to abut the bottom's rear wall and is hinged thereto. The container includes stop means which prevent opening rotation of the cover with respect to the bottom beyond a predetermined opening angle, which may be for example about 90 degrees. The construction of the stop means are such, however, that upon construction the box may be formed with the top in a fully open position, clear of the bottom, to allow efficient filling thereof.

With the cover at the predetermined opening angle, the cover's rear wall extends horizontally rearwardly from the container bottom's rear wall, forming a shelf or balcony extension for the container, and effectively extending the bottom surface area of the container. When the container is filled, the loaded items are mounted on the balcony, as well as on the container bottom.

The construction of the container allows the container to be preferably formed in a single injection molding or similar process as a unitary blank of plastic construction with a self hinge between the container bottom and cover. The rear wall of container is formed with a relief angle to facilitate the molding process, providing a draft or clearance which allows the molding to be performed with the cover in a full open, flat orientation to limit the necessary height of the mold and simplify the molding process. The cover can then be pivoted to the predetermined open angle for filling a part of an automated production process.

BRIEF DESCRIPTION OF THE DRAWINGS

A fuller understanding of the present invention will be accomplished upon consideration of the following detailed description of a preferred, but nonetheless illustrative embodiment thereof, when reviewed in association with the annexed drawings, wherein:

FIG. 1 is a perspective view of a container constructed in accordance with the present invention shown in the closed position;

FIG. 2 is a front elevation view thereof;

DETAILED DESCRIPTION OF THE INVENTION

Figure 4:
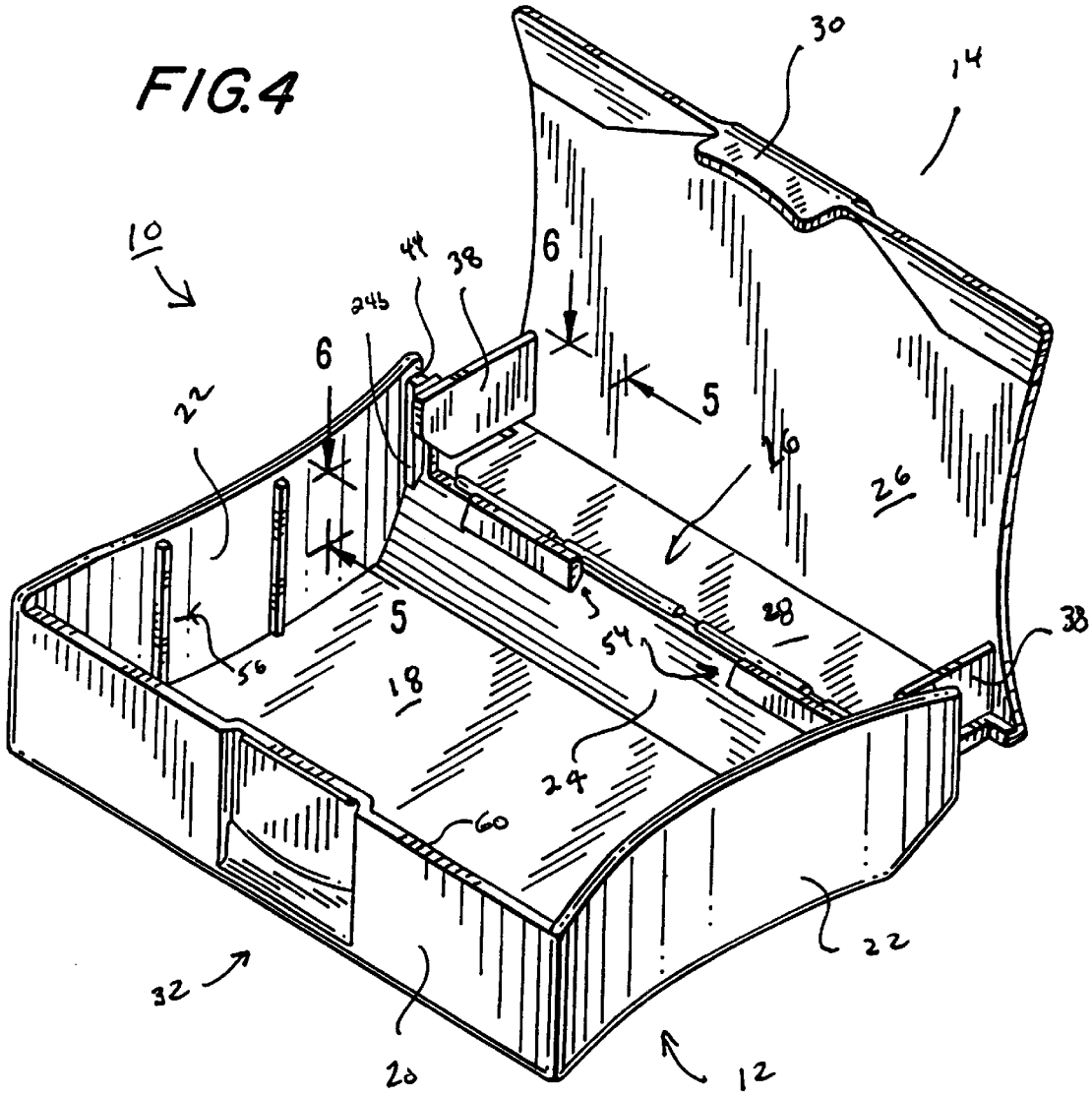
FIG. 4 is a perspective view depicting the container in the open configuration in which the cover rear wall forms a shelf or balcony allowing the container to be efficiently filled.

With initial reference to the Figures and particularly FIGS. 1 and 4, a container 10 constructed in accordance with the present invention may be fabricated from an appropriate plastic using molding techniques as generally known in the trade. The container 10 includes a bottom portion 12 and a cover 14 pivotally affixed to the bottom along a hinge 16. The bottom 12 comprises floor 18, a front wall 20, a pair of opposed side walls 22, and a rear wall 24. The cover 14 includes top wall 26 and rear wall portion 28. A latch mechanism 30 is formed integral with the cover at the front edge thereof and engages a corresponding portion 32 of the bottom front wall 20. In the preferred embodiment of the invention depicted the hinge 16 is a self hinge, allowing the container to be fabricated as a one-piece construction.

Figure 3:
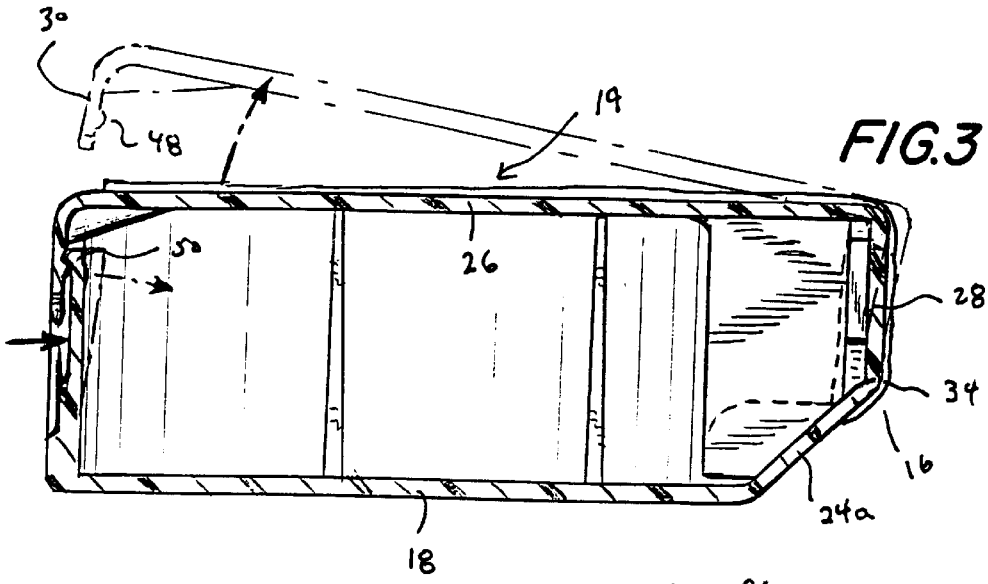
FIG. 3 is a section view taken along line 3—3 of FIG. 2.
Figure 5:
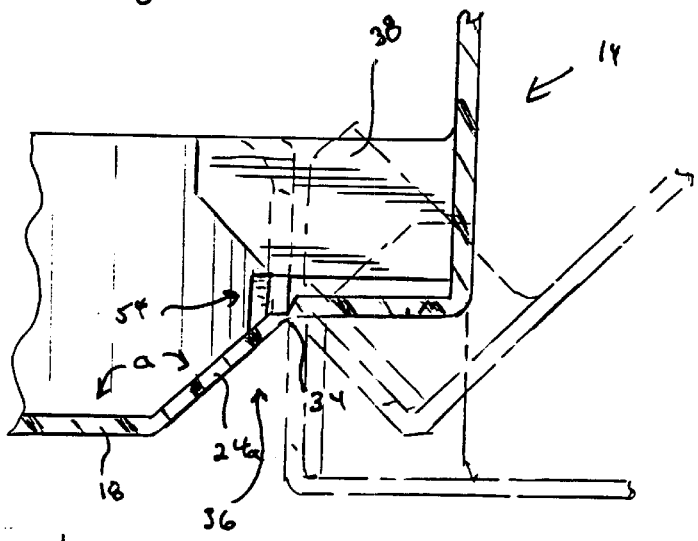
FIG. 5 is a detail view in section taken along line 5—5 of FIG. 1 showing the hinge and stop mechanism depicting the cover in the vertical position as seen in FIG. 4 and, in phantom, in further rotated positions, the extreme rotated position corresponds to the position in which the container is molded.

As further detailed in FIGS. 3 and 5, the container bottom 12 includes a rear wall 24 which comprises a main lower sloped portion 24*a* extending across the width of the container bottom and a pair of opposed vertical wall side stub portions 24*b* (best seen in FIG. 4) between which is positioned the cover's rear wall 28. The sloped rear wall portion 24*a* extends backwardly and upwardly from the container floor 18 and includes at its rear and topmost edge integral hinge portions 34, formed as a narrowed or necked portion of the construction and which join the top of rear wall 24 to the bottom of rear wall 28 of the cover. Forming bottom rear wall 24 outwardly at the angle "a" in FIG. 5, which may be on the order of 135 degrees, permits the entire container to be injection molded in a known manner in a single, low profile molding process, since a space or draft 36 as shown in FIG. 5 exists between the container bottom, and particularly the rear wall 24, and the cover, and particularly its rear wall 28, with the cover in the fully opened configuration for molding, exposing the hinge portions 34 so that they can be properly formed in a single molding step. Conventional container designs, utilizing a vertical rear wall, require complicated and costly molds and/or procedures, particularly to form the narrowed self or live hinge portions 34. Similarly, by including the rear wall as part of the cover, increased height for the container can be provided without significant loss of interior space which would occur if the slanted rear wall 24 of the container bottom extended the full height.

The aforesaid structural features allows the molding for the container to utilize a mold in which the orientation of the cover is in a fully open, horizontally-extending position, as shown in FIG. 5, permitting economical fabrication of the container. In addition, however, foreshortening of the container rear wall 24, and placement of the hinge below the top surface of the box in conjunction with a cover rear wall allows the effective bottom surface area of the box to be expanded, as seen in FIGS. 4 and 5, by the creation of a horizontal ledge or balcony extending rearwardly from the hinge 34 formed by the rear wall 28 of the cover when the cover is in the vertical orientation. The positioning of the cover in such a position during the product loading allows product, such as wrapped mints, to be loaded into the box with the balcony serving as an additional extended loading surface for the items in addition to the container floor 18. The items stacked or loaded upon the balcony are subsequently compressed into the closed box volume when the cover is closed. It has been determined that the loading item, and in particular paper or foil-wrapped items, such as mints, into a conventional box having a top cover hinge is inefficient, since the volume utilized by the items when initially loaded into the container is much greater than the true volume of the product, due to the volume taken by the wraps when the items are randomly loaded into the container. The present invention allows a greater effective volume and quantity of items to be loaded into the container, the items resting upon the balcony which otherwise would not have been directed into the container, being directed forwardly into the main, closed volume of the container when the cover is pivoted forwardly, resulting in a closer pack of the items and allowing a greater volume of items to be loaded.

The efficiency of the current package configuration is further enhanced by the use of stop arms to support the cover in the vertical position for loading. As further detailed in FIGS. 4 and 6, the cover includes a pair of stop arms 38 located on its top wall 26 adjacent the side edges thereof and proximate the cover rear wall 28. The arms each include an outwardly-directed locking tab 40 having a shoulder 42 which engages with the forward-facing surface of the corresponding rear wall side portions 24*b*. The wall portions 24*b* may terminate below the upper edge of the container bottom side walls 22 to form a flat or support 44 for the rear portion of the cover when closed.

Figure 6:
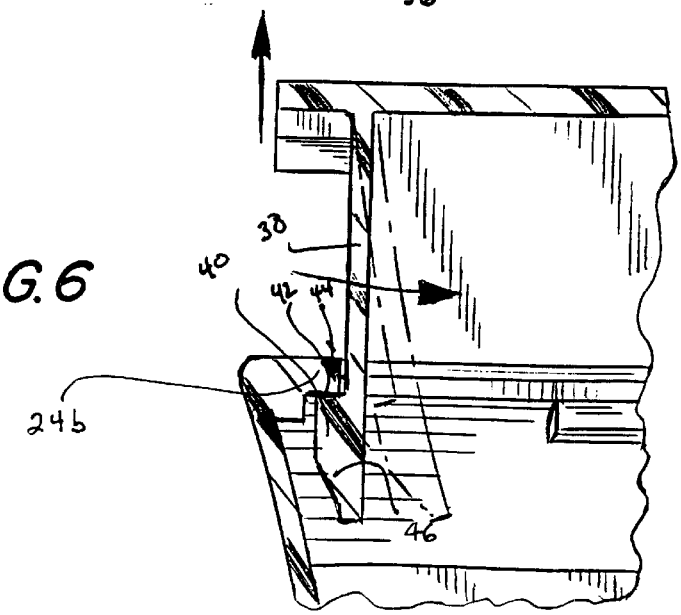
FIG. 6 is a partial section view taken along line 6—6 further depicting the hinge mechanism and the associated stop mechanism.

The locking tabs 40 are also formed with a frontal cam surface 46 which, when the cover is moved from a fully opened position as shown in phantom in FIG. 5, direct the locking tabs and stop arms inwardly to clear the wall portions 24*b*, allowing the cover to pivot counterclockwise in FIG. 5 to the vertical and subsequently to the full closed position. Once the locking tabs 40 have cleared the rear wall portions 24*b* upon such rotation, however, subsequent clockwise rotation (with reference to FIG. 5) to open the cover results in engagement between the rear wall portions 24*b* and the flats 42, preventing the cover from opening beyond the interference position which may be, for example, on the order of 90 degrees as depicted in FIG. 4. If full opening is desired, however, gentle inward pressure upon the stop arms, as shown in FIG. 6, allow the stop arms to clear the rear wall edges, allowing full opening of the cover.

When the cover is positioned at about the vertical, and preferably at an angle of about 86 degrees counterclockwise from the horizontal as may be dictated by the engagement of the locking tabs, the positions of the stop arms serve as a pair of small side walls for the rear wall portion 28 acting as the bottom surface extension, maintaining loaded product upon the extension and preventing them from exiting the container through the sides as the cover is closed. As the center of mass for the cover is located rearwardly of the hinge with the cover in the vertical position, a clockwise movement exists about the hinge, assisting in maintaining the cover in the vertical position during the fill.

The front edge of the cover top wall 26 includes a depending latch or catch member 30 which includes an inwardly-directed, horizontal ridge 48 as seen in FIG. 3. The front wall 20 of the container bottom 12 is provided with a corresponding recessed area 50 having a forward-extending ridge 52 at the top thereof which, as best seen in FIG. 3, interengages with the ridge 48 on the latch cover to provide a locking mechanism between the bottom and top. Gentle inward pressure on the recessed area 50, as shown by the arrow in FIG. 3, allows separation between the ridge portions, disengage the locking action therebetween and allowing the cover to be pivoted upwardly. The recessed construction in the front wall 20 allows the cover catch 30 to rest flush with the major portion of the front wall 20, providing a smooth transition between the front wall and the latch.

As further seen in the figures, and particularly FIGS. 4 and 5, a pair of stops 54 are located on the rear wall 24 adjacent the top edge thereof. The stops 54, which are also molded integrally with the container construction, provide a backstop for the cover rear wall 28 in conjunction with the flats 44 of the rear wall portions 24*b* when the cover is in the closed position, counteracting inward pressure on the cover, such as might be applied when the container is gripped by the user for opening purposes, and preventing rupture of the more delicate self hinge portion 34. As depicted in FIG. 3, to further reinforce the hinges, an overlying sheet-like member, such as a portion of an adhesive label 58 for the container and contents, may overlie the hinges.

As may be seen in FIG. 4, the side walls 22 of the container bottom may be provided with vertical reinforcement spines 56 which also terminate below the top edge of the side walls 22 and help support the cover when closed. The side walls of the bottom may be of a concave curved configuration, the side edges of the cover top wall 26 having a corresponding and mating curvature. The top edge 60 of the front wall 20 may be slightly depressed above the height of the top edge of the side walls 22 in the same manner as is the top of the rear wall portions 24*b,* the cover top wall 26 being of a width to close interior-wise of the side walls 22 to rest upon the top of the front wall 20 as well as the spines 56.

I claim:

1. A container, comprising:

a bottom having a floor and upstanding peripheral side walls, a front wall and a rear wall forming a peripheral wall top edge, the top edge portion formed by a major portion of the rear wall being depressed below the top edge formed by the other walls;

a cover pivotally affixed to said rear wall by a hinge, said cover having a depending rear wall forming a balcony for the acceptance of items with which the container is to be filled; and stop means mounted to the cover and bottom for maintaining the cover in an open position such that the rear wall of the cover extends rearwardly parallel to the base of the bottom to serve as said balcony, said stop means being two in number, are located on opposite sides of the cover, and each comprise a hook located at an end of an arm mounted to said cover and a ledge located on a peripheral side wall, the arms serving as side walls for the balcony.

2. The container of claim 1 wherein the hook includes a cam surface allowing for one-way passage of said hook past said ledge.

3. The container of claim 1 wherein said arms are mounted to said cover and serve as side walls for the balcony.

4. The container of claim 3 wherein the bottom rear wall includes opposed stub portions extending upwardly beyond the top edge of the major portion of the rear wall and having top surfaces to support the cover when in a closed position.

5. The container of claim 4 wherein the cover is dimensioned to fit between the side walls of the bottom when in a closed position.

6. The container of claim 5 wherein the cover is dimensioned to rest upon the front wall of the bottom when in the closed position.

7. The container of claim 5 further comprising reinforcing spines located on said side walls, said spines having a top surface to support the cover when in a closed position.

8. A method for the packaging of small items, comprising the steps of:

forming a container having a bottom with a floor and upstanding peripheral side walls, a front wall and a rear wall forming a peripheral wall top edge, the top edge portion formed by a major portion of the rear wall being depressed below the top edge formed by the other walls, a cover pivotally affixed to said rear wall by a hinge, said cover having a depending rear wall and stop means mounted to the cover and bottom for maintaining the cover in an open position such that the rear wall of the cover extends rearwardly parallel to the base of the bottom from a unitary blank of material;

rotating the container cover to the open position;

filling the container with items to be packaged in a manner whereby the items rest on both the container base and the rear wall of the cover; and pivoting the cover to a closed position such that the items resting on the rear wall of the cover move into positions on and above the base such that the closed container may be fully filled with the items.

9. A container, comprising:

a bottom having a floor and upstanding peripheral side walls, a front wall and a rear wall forming a peripheral wall top edge, the top edge portion formed by a major portion of the rear wall being depressed below the top edge formed by the other walls, the rear wall extending upwardly and rearwardly at an obtuse angle to the base;

a cover pivotally affixed to said rear wall by a hinge, said cover having a depending rear wall forming a balcony for the acceptance of items with which the container is to be filled; and stop means mounted to the cover and bottom for maintaining the cover in an open position such that the rear wall of the cover extends rearwardly parallel to the base of the bottom to serve as said balcony, said stop means being two in number, are located on opposite sides of the cover, and each comprise a hook located at an end of an arm mounted to said cover and a ledge located on a peripheral side wall.

* * * * *